US010745847B2

(12) United States Patent
Sakal et al.

(10) Patent No.: US 10,745,847 B2
(45) Date of Patent: Aug. 18, 2020

(54) DISPENSING ASSEMBLY FOR A BULK TANK OF A WASHING MACHINE APPLIANCE

(71) Applicant: Haier US Appliance Solutions, Inc., Wilmington, DE (US)

(72) Inventors: Eric Ormsby Sakal, Louisville, KY (US); Alexander B. Leibman, Prospect, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 181 days.

(21) Appl. No.: 15/880,585

(22) Filed: Jan. 26, 2018

(65) Prior Publication Data

US 2019/0234000 A1 Aug. 1, 2019

(51) Int. Cl.
*D06F 39/02* (2006.01)

(52) U.S. Cl.
CPC ..... *D06F 39/02* (2013.01)

(58) Field of Classification Search
CPC ..... D06F 39/02
USPC ..... 68/17 R
See application file for complete search history.

(56) References Cited

U.S. PATENT DOCUMENTS

| | | | | |
|---|---|---|---|---|
| 3,988,908 | A | 11/1976 | Beare et al. | |
| 4,467,627 | A * | 8/1984 | Platt | D06F 39/02 137/565.11 |
| 9,033,606 | B2 | 5/2015 | Turchi et al. | |
| 2001/0010165 | A1* | 8/2001 | Kubota | D06F 35/004 68/12.12 |
| 2012/0159998 | A1* | 6/2012 | Bolduan | D06F 39/022 68/17 R |

FOREIGN PATENT DOCUMENTS

WO WO2017039185 A1 3/2017

* cited by examiner

*Primary Examiner* — Tinsae B Ayalew
(74) *Attorney, Agent, or Firm* — Dority & Manning, P.A.

(57) ABSTRACT

A washing machine appliance includes a cabinet having a top panel and a wash tub positioned within the cabinet and defining a wash chamber for receipt of articles for washing. A bulk tank is positioned below the top panel and defines a reservoir for storing wash additive, the reservoir defining a primary outlet for supplying wash additive into the wash chamber. In addition, a dispensing device, which may include a manual pump, a gravity fed supply valve, or an electronic pump, is fluidly coupled to the reservoir and conveniently positioned for selectively dispensing wash additive, e.g., for pretreating an article of clothing.

19 Claims, 6 Drawing Sheets

DISPENSING ASSEMBLY FOR A BULK TANK OF A WASHING MACHINE APPLIANCE

FIELD OF THE INVENTION

The present subject matter relates generally to washing machine appliances and more particularly to bulk tank dispensing assemblies for washing machine appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash and/or rinse articles within the wash chamber. However, in certain situations, a user may wish to pretreat an article of clothing, e.g., by spot treating a specific region on the article with wash additive such as detergent. However, conventional washing machine appliances do not include integral features for providing a small, localized quantity of detergent to an article of clothing for pretreating purposes. Although a user could pour detergent directly from the bottle or use a stand-alone applicator to pretreat an article of clothing, such options are typically messier and require additional tools which are not often conveniently stored or accessible.

Accordingly, a washing machine appliance that provides a quick and easy feature for dispensing a wash additive such as detergent is desirable. In particular, a dispensing assembly that is integral to a bulk tank of a washing machine appliance and enables quick and effective dispensing of wash additive would be particularly beneficial.

BRIEF DESCRIPTION OF THE INVENTION

The present subject matter provides a washing machine appliance including a cabinet having a top panel and a wash tub positioned within the cabinet and defining a wash chamber for receipt of articles for washing. A bulk tank is positioned below the top panel and defines a reservoir for storing wash additive, the reservoir defining a primary outlet for supplying wash additive into the wash chamber. In addition, a dispensing device, which may include a manual pump, a gravity fed supply valve, or an electronic pump, is fluidly coupled to the reservoir and conveniently positioned for selectively dispensing wash additive, e.g., for pretreating an article of clothing. Additional aspects and advantages of the invention will be set forth in part in the following description, or may be apparent from the description, or may be learned through practice of the invention.

In one exemplary embodiment, a washing machine appliance defining a vertical, a lateral, and a transverse direction is provided. The washing machine appliance includes a cabinet including a top panel and a wash tub positioned within the cabinet and defining a wash chamber for receipt of articles for washing. A bulk tank is positioned below the top panel and defines a reservoir for storing wash additive, the reservoir defining a primary outlet in fluid communication with the wash chamber. A dispensing device is fluidly coupled to the reservoir, the dispensing device being configured for selectively dispensing the wash additive.

In another exemplary embodiment, a bulk dispensing assembly for a washing machine appliance is provided. The washing machine appliance includes a cabinet including a top panel and a wash tub positioned within the cabinet and defining a wash chamber. The bulk dispensing assembly includes a bulk tank positioned below the top panel and defining a reservoir for storing wash additive, the reservoir defining a primary outlet in fluid communication with the wash chamber. A dispensing device is fluidly coupled to the reservoir, the dispensing device being configured for selectively dispensing the wash additive.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
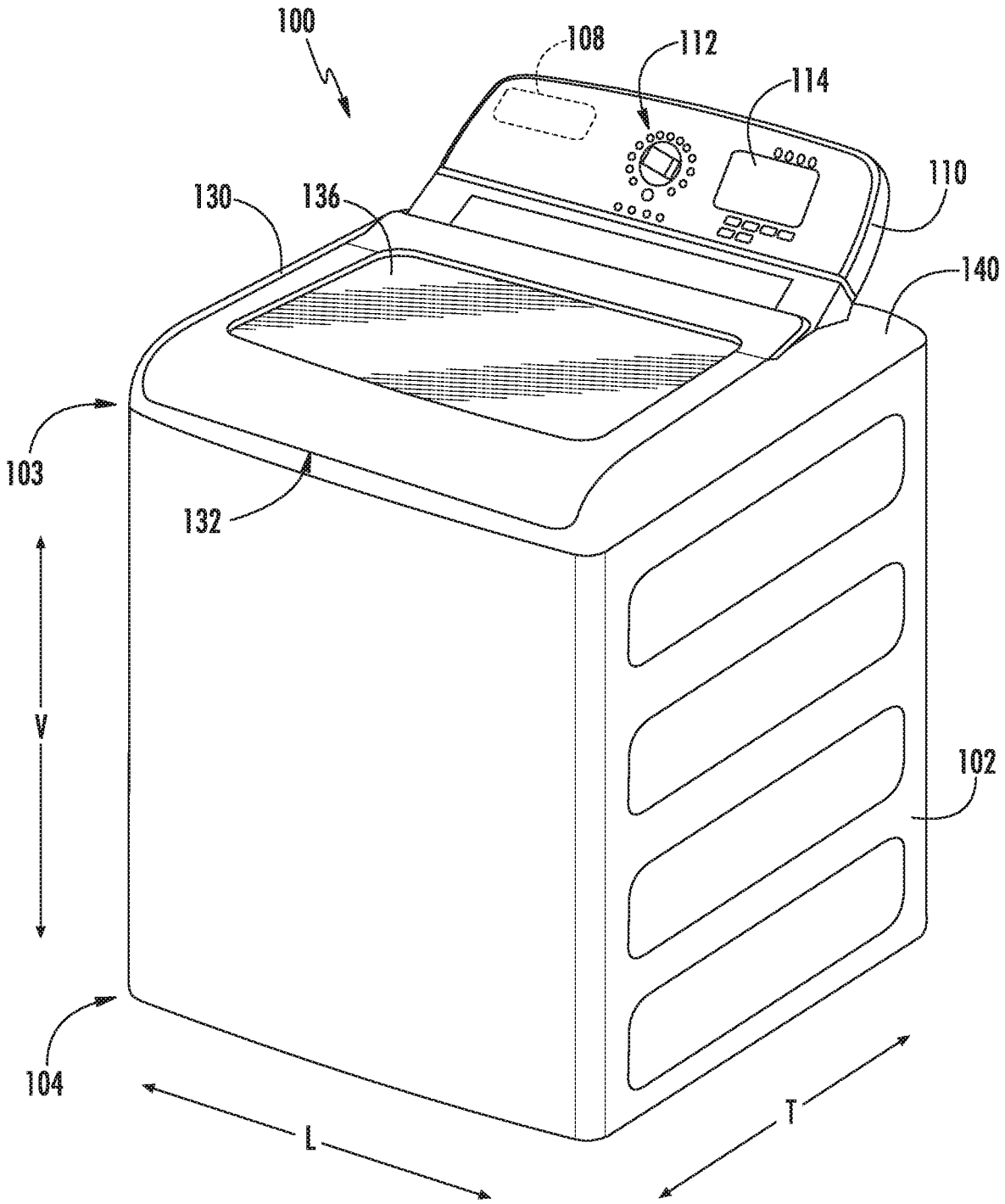
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
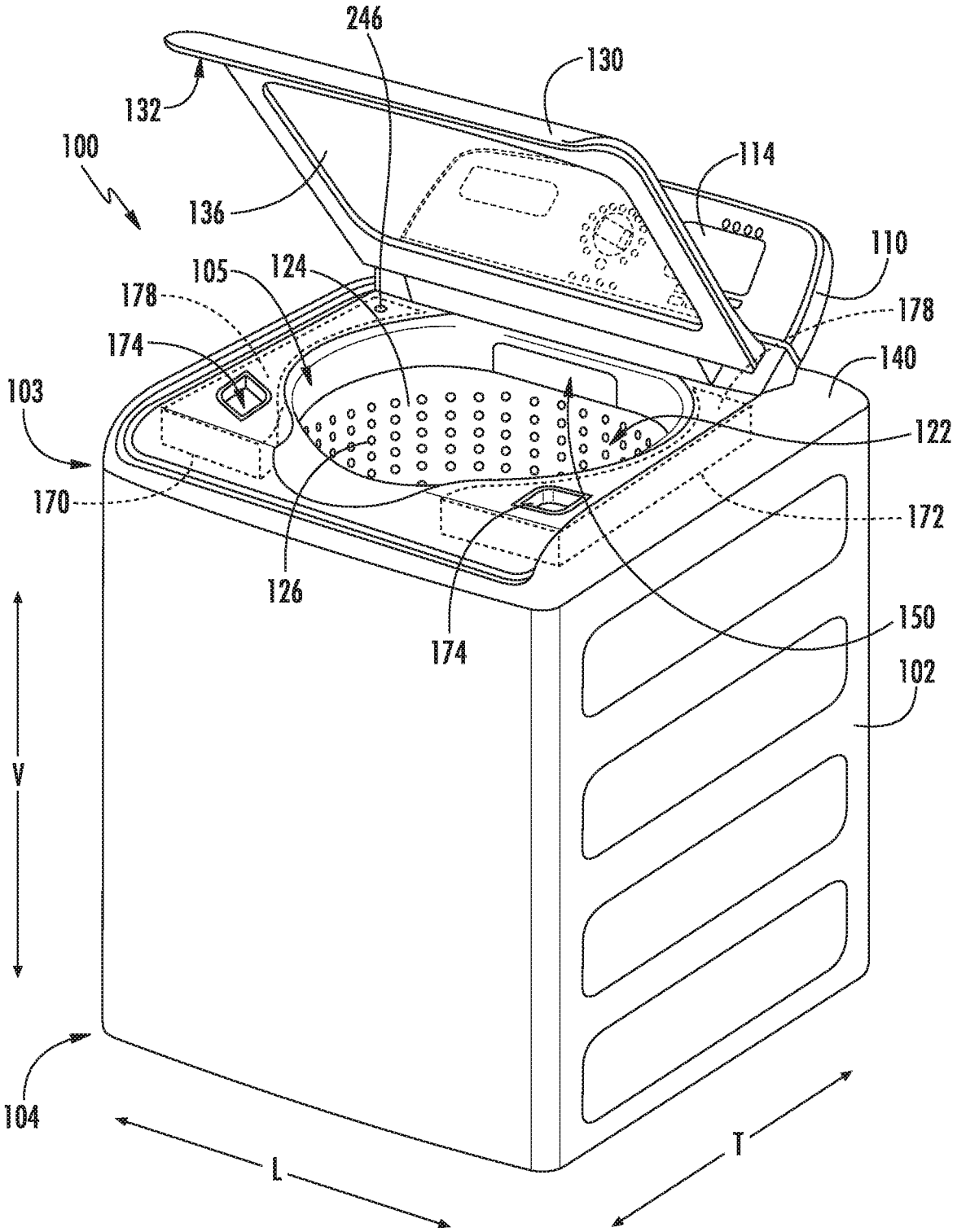
FIG. 2 provides a perspective view of the exemplary washing machine appliance of FIG. 1 with the door of the exemplary washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines. Moreover, aspects of the present subject matter may be used in any other consumer or commercial appliance where it is desirable to facilitate quick and easy application of a wash additive for a pretreat operation.

Washing machine appliance 100 has a cabinet 102 that extends between a top portion 103 and a bottom portion 104 along the vertical direction V. A wash tub 120 (see FIG. 4) is positioned within the cabinet 102 and generally defines a wash chamber 122. A wash basket 124 is rotatably mounted within the wash tub 120 and is configured for receipt of articles for washing. Wash basket 124 defines a plurality of perforations 126 to permit wash fluid to flow through wash basket 124. A motor (not shown) is in mechanical communication with wash basket 124 to selectively rotate wash basket 124 (e.g., during an agitation or a rinse cycle of washing machine appliance 100). During an operating cycle, wash tub 120 holds wash and rinse fluids for agitation in wash basket 124 within wash tub 120. An agitator or impeller 138 (see FIGS. 5 and 7) extends into wash basket 124 and is also in mechanical communication with the motor. The impeller assists agitation of articles disposed within wash basket 124 during operation of washing machine appliance 100.

Cabinet 102 of washing machine appliance 100 has a top panel 140. Top panel 140 defines an opening 105 (FIG. 2) that permits user access to wash basket 124 of wash tub 120. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 124. Conversely, in the open position, a user can access wash basket 124. A window 136 in door 130 permits viewing of wash basket 124 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 124 through opening 105, and washing operation is initiated through operator manipulation of input selectors 112. Wash basket 124 is filled with water and detergent and/or other fluid additives via a primary dispenser 150. One or more valves can be controlled by washing machine appliance 100 to provide for filling wash basket 124 to the appropriate level for the amount of articles being washed and/or rinsed. By way of example for a wash mode, once wash basket 124 is properly filled with fluid, the contents of wash basket 124 can be agitated (e.g., with an impeller as discussed previously) for washing of laundry items in wash basket 124.

After the agitation phase of the wash cycle is completed, wash basket 124 can be drained. Laundry articles can then be rinsed by again adding fluid to wash basket 124 depending on the specifics of the cleaning cycle selected by a user. The impeller may again provide agitation within wash basket 124. One or more spin cycles also may be used. In particular, a spin cycle may be applied after the wash cycle and/or after the rinse cycle to wring wash fluid from the articles being washed. During a spin cycle, wash basket 124 is rotated at relatively high speeds. After articles disposed in wash basket 124 are cleaned and/or washed, the user can remove the articles from wash basket 124, e.g., by reaching into wash basket 124 through opening 105.

Referring now generally to FIGS. 3 through 8, bulk dispensing assemblies and dispensing devices 200 will be described according to various exemplary embodiments of the present subject matter. Although the discussion below refers to exemplary dispensing devices, one skilled in the art will appreciate that the features and configurations described may be used for dispensing any suitable wash fluid in any suitable washing machine appliances. For example, dispensing devices 200 may be positioned in another location within cabinet 102 and may be fluidly coupled to any fluid reservoir containing any suitable wash fluid or fluids such as water, detergent, other additives, or mixtures thereof. Other variations and modifications of the exemplary embodiment described below are possible, and such variations are contemplated as within the scope of the present subject matter.

As shown in FIG. 2, washing machine appliance 100 may include one or more reservoirs or tanks for storing wash additives for use during operating cycles. More specifically, washing machine appliance 100 may include bulk tanks designed to store enough wash additive to perform multiple operating cycles. In this regard, for example, washing machine appliance 100 includes a first bulk tank 170 that is generally configured for receiving a first wash additive, e.g., such as liquid detergent. Similarly, washing machine appliance 100 may include a second bulk tank 172 that is generally configured for receiving a second wash additive, e.g., such as fabric softener or another suitable additive. In order to supply large volumes of wash additive into bulk tanks 170, 172, these tanks and top panel 140 may together define loading ports 174 for supplying the respective tanks 170, 172 with wash additives. As illustrated, loading ports 174 may be positioned adjacent dispensing device 200. In addition, according to an exemplary embodiment, loading port 174 may act as a venting means for bulk tanks 170 and/or 172.

As illustrated, first bulk tank 170 is a large bulk additive dispenser positioned below top panel 140 on a left side of washing machine appliance 100. For example, first bulk tank 170 may be a plastic dispenser snapped into or otherwise joined within top panel 140. To maximize the storage volume, first bulk tank 170 may generally extend between top 103 of washing machine appliance 100 and a top of wash tub 120. In addition, first bulk tank 170 may wrap around opening 105 and maybe contoured to fit in any void space within top panel 140. Second bulk tank 172 may be constructed and positioned similarly to first bulk tank 170, but on the right side of washing machine appliance 100. It should be appreciated that according to alternative embodiments, dispensing devices described herein may be used with any suitable storage reservoir tank positioned within washing machine appliance 100.

Figure 4:
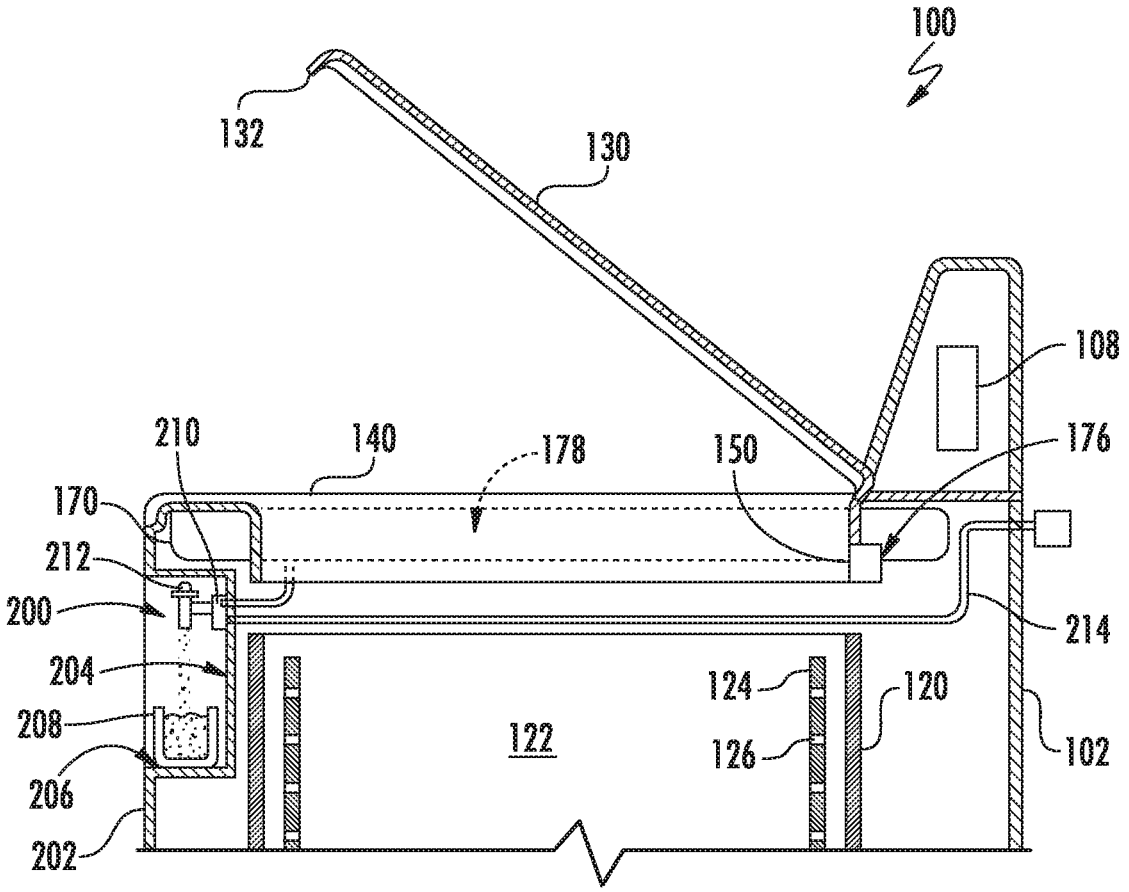
FIG. 4 provides a schematic side view of the exemplary dispensing assembly of FIG. 3 according to an exemplary embodiment of the present subject matter.

In order to dispense wash additive into wash chamber 124, each bulk tank 170, 172 may define a primary outlet 176 for discharging wash additive into wash tub 120. Referring for example to FIGS. 2 and 4, first bulk tank 170 may define a first reservoir 178 for storing liquid detergent and primary outlet 176 may be directly fluidly coupled to primary dispenser 150. In this manner, primary dispenser 150 may selectively dispense liquid detergent into wash chamber 122 directly from first bulk tank 170 prior to or during an operating cycle. According to still another embodiment, primary outlet 176 of first bulk tank 170 may open directly into wash tub 120 and may be controlled by a dedicated valve. Other valve and plumbing configurations are possible and within the scope of the present subject matter.

Figure 3:
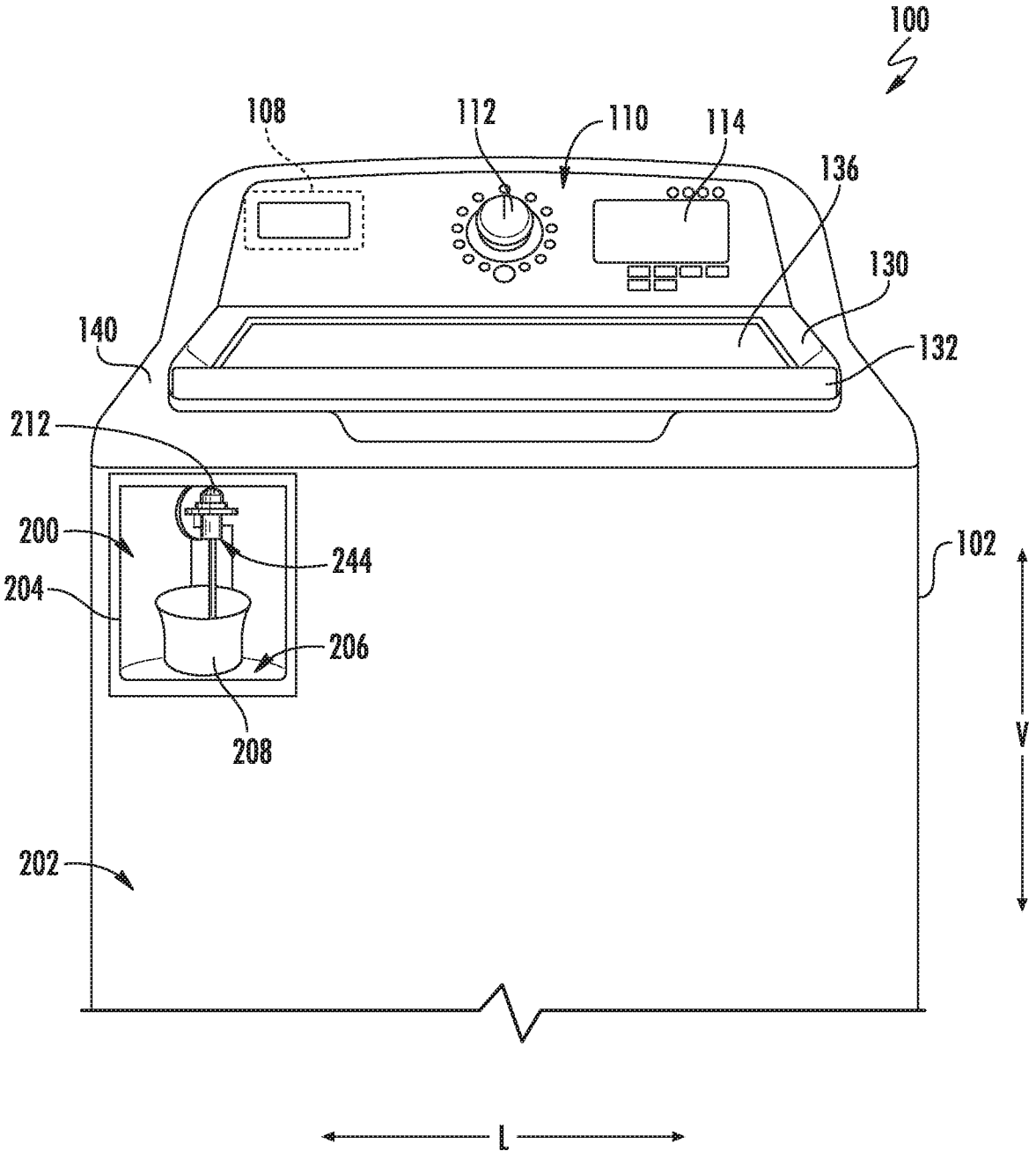
FIG. 3 provides a front view of the exemplary washing machine appliance of FIG. 1 including a dispensing assembly for dispensing wash fluid according to an exemplary embodiment of the present subject matter.

Referring now to FIGS. 3 and 4, a dispensing device 200 will be described according to an exemplary embodiment of the present subject matter. As illustrated, dispensing device 200 is fluidly coupled to reservoir 178 and is generally configured for selectively dispensing the wash additive contained therein, e.g., liquid detergent. According to an exemplary embodiment, dispensing device 200 may be a nozzle extending from of cabinet 102, e.g., from a front panel 202. According to the illustrated embodiment, front panel 202 of cabinet 102 further defines a dispenser recess 204. Dispenser recess 204 may be similar to a dispensing station on a refrigerator appliance and may define a platform cup holder 206 for receiving a container 208.

As illustrated, dispensing device 200 may be positioned within dispenser recess 204 and may include an electronic pump 210 for urging a flow of liquid detergent into container 208, e.g., in response to user input via a button 212 or another suitable input. In addition, according to an exemplary embodiment, dispensing device 200 may further include a water feed line 214 for supplying the flow of water through dispensing device 200. Feed line 214 may be connected through electronic pump 210 or may rely on supply pressure to provide the desired flow of water in response to button 212 or another button or input. Although electronic pump 210 is illustrated as being connected directly to dispensing device 200 at front panel 202, it should be appreciated that electronic pump 210 could instead be positioned within first bulk tank 170 or at any other suitable location in fluid communication with dispensing device 200 or reservoir 178. In addition, according to alternative embodiments, dispensing device 200 could instead rely on gravity to feed through a manually actuated valve, could use a manual pump, or could rely on any other means for pressurizing or supplying wash fluid.

Other exemplary dispensing devices will be described below and it should be appreciated that aspects of the various embodiments disclosed herein may be interchangeable with other described embodiments. In addition, although dispensing devices 200 are described herein as being fluidly coupled to first bulk tank 170 for dispensing liquid detergent, it should be appreciated that the same or different dispensing devices may be fluidly coupled to a second storage tank, such as second bulk tank 172 and may be configured for dispensing a second wash additive, such as fabric softener. The exemplary configurations described herein are not intended to limit the scope of the present subject matter.

Figure 5:
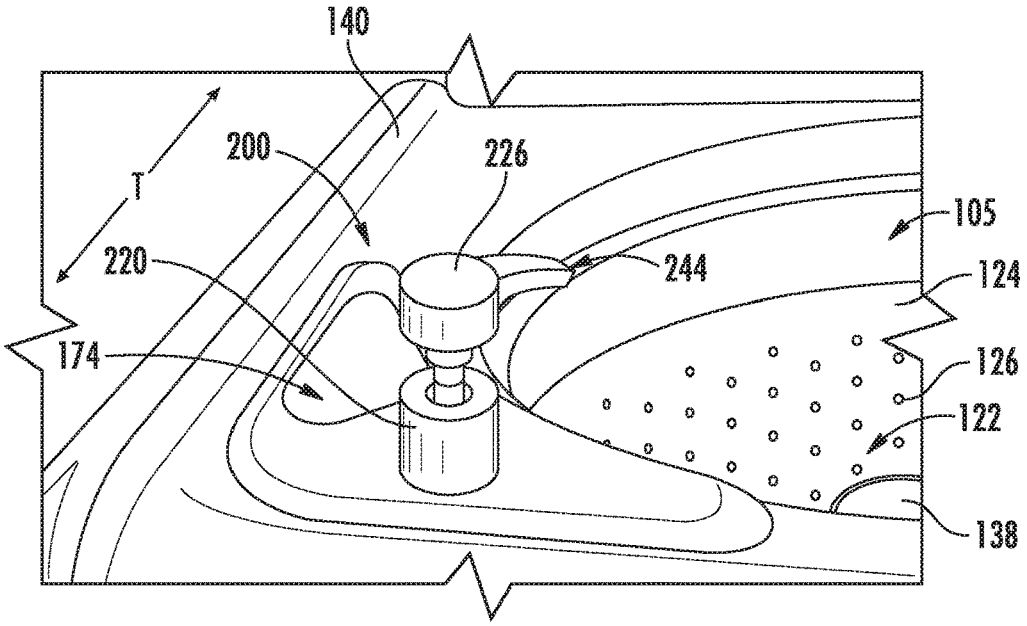
FIG. 5 provides a close-up perspective view of the exemplary washing machine appliance of FIG. 1 including a dispensing assembly for dispensing wash fluid according to another exemplary embodiment of the present subject matter.
Figure 6:
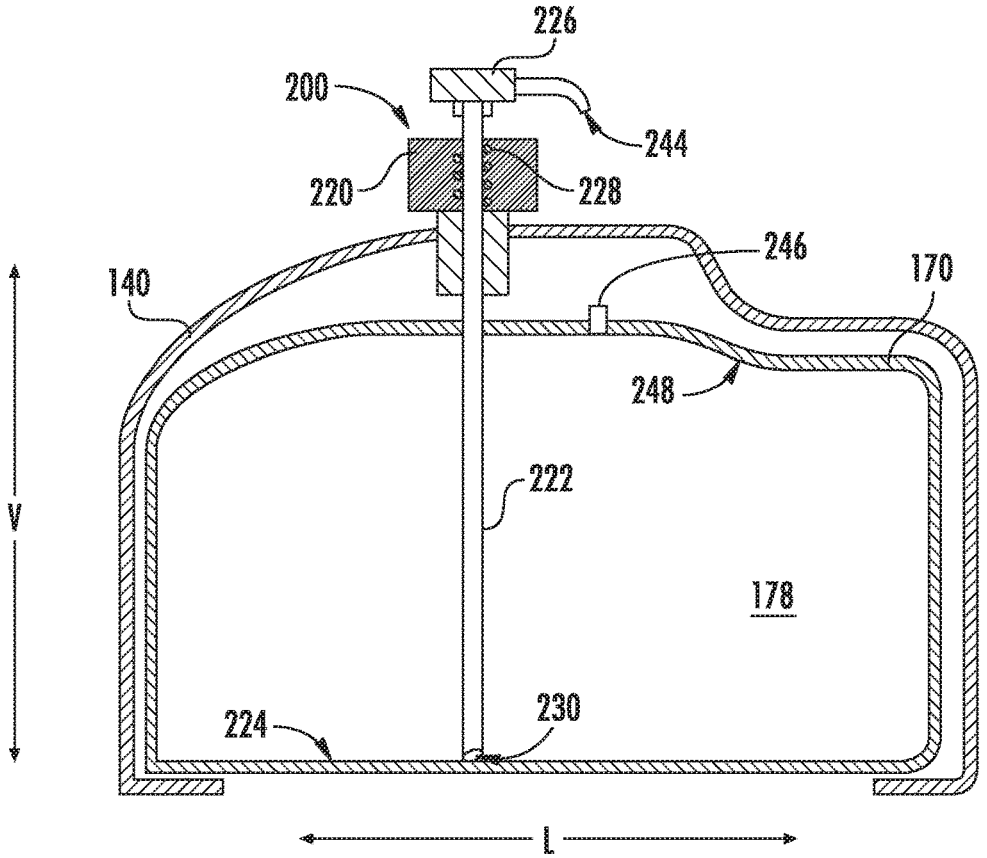
FIG. 6 provides a front cross sectional view of the exemplary dispensing assembly of FIG. 5 according to an exemplary embodiment of the present subject matter.

Referring now to FIGS. 5 and 6, dispensing device 200 will be described according to an alternative exemplary embodiment. As shown, dispensing device 200 includes a manual pump dispenser 220 for urging a flow of liquid detergent from reservoir 178, e.g., for pretreatment purposes. As best shown in FIG. 6, manual pump dispenser 220 includes a dip tube 222 that extends to a bottom 224 of reservoir 178. Manual pump dispenser 220 is generally configured to operate like a standard household soap dispenser or any other highly viscous liquid dispenser, e.g., such that a user presses down on nozzle 226 to urge liquid detergent out of manual pump dispenser 220. Manual pump dispenser 220 further includes a spring 228 for returning nozzle 226 to its original position so that a user can repeat the process to pump the desired amount of liquid detergent.

According to the illustrated embodiment, dip tube 222 and nozzle 226 of manual pump dispenser 220 may extend substantially along the vertical direction V. In this manner, a user may pretreat articles of clothing at a comfortable standing height prior to beginning an operating cycle. It should be appreciated that as used herein, terms of approximation, such as "approximately," "substantially," or "about," refer to being within a ten percent margin of error. However, it should be appreciated that according to alternative embodiments, manual pump dispenser 220 may extend in any suitable direction, for any suitable distance, and may be actuated in any other suitable manner. For example, manual pump dispenser 220 may include a flexible hose to permit a user to pull nozzle 226 over and into opening 105 to minimize the risk of wash additive being dispensed outside of wash chamber 122.

As also illustrated in FIG. 6, dip tube 222 defines a dispensing inlet 230 positioned at a lowest point of reservoir 178, e.g., at bottom 224. In this manner, all of the wash additive first bulk tank 170 may be discharged using manual pump dispenser 220. This prevents a user from having to refill reservoir 178 before all the liquid detergent has been used. The ability to remove all detergent from reservoir 178 may also be useful when washing machine appliance 100 is being serviced, when a user wishes to change detergents, or when a user wishes to sell the appliance. Referring again to FIG. 5, nozzle 226 may be designed to fit underneath door 130 when door 130 is in the closed position (as shown in FIG. 1).

Figure 7:
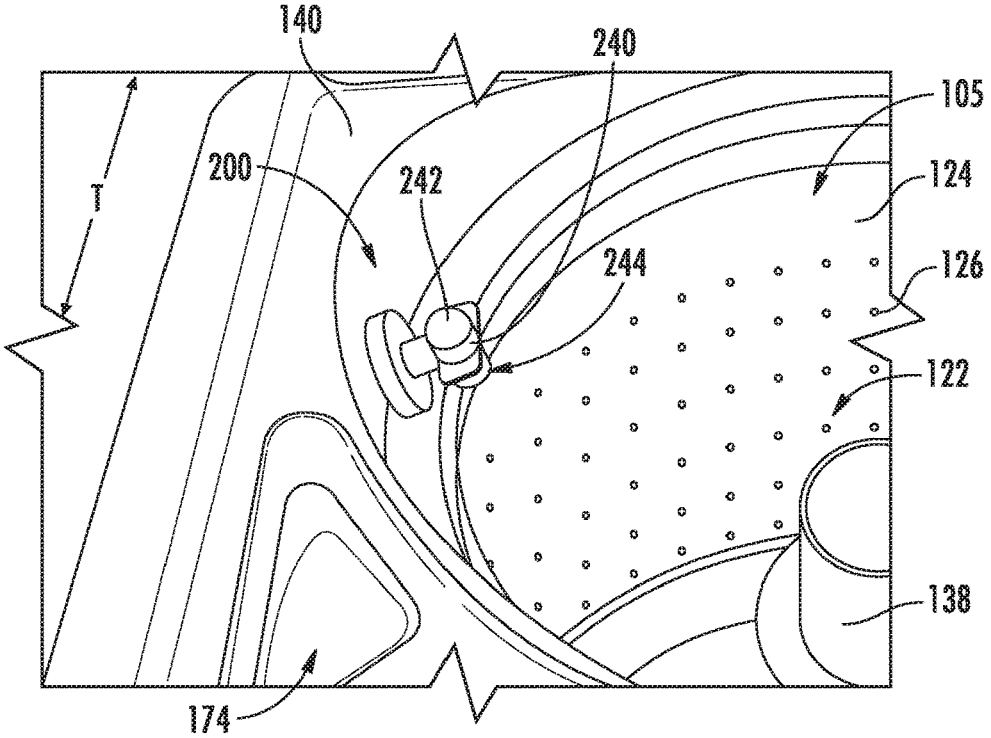
FIG. 7 provides a close-up perspective view of the exemplary washing machine appliance of FIG. 1 including a dispensing assembly for dispensing wash fluid according to another exemplary embodiment of the present subject matter.
Figure 8:
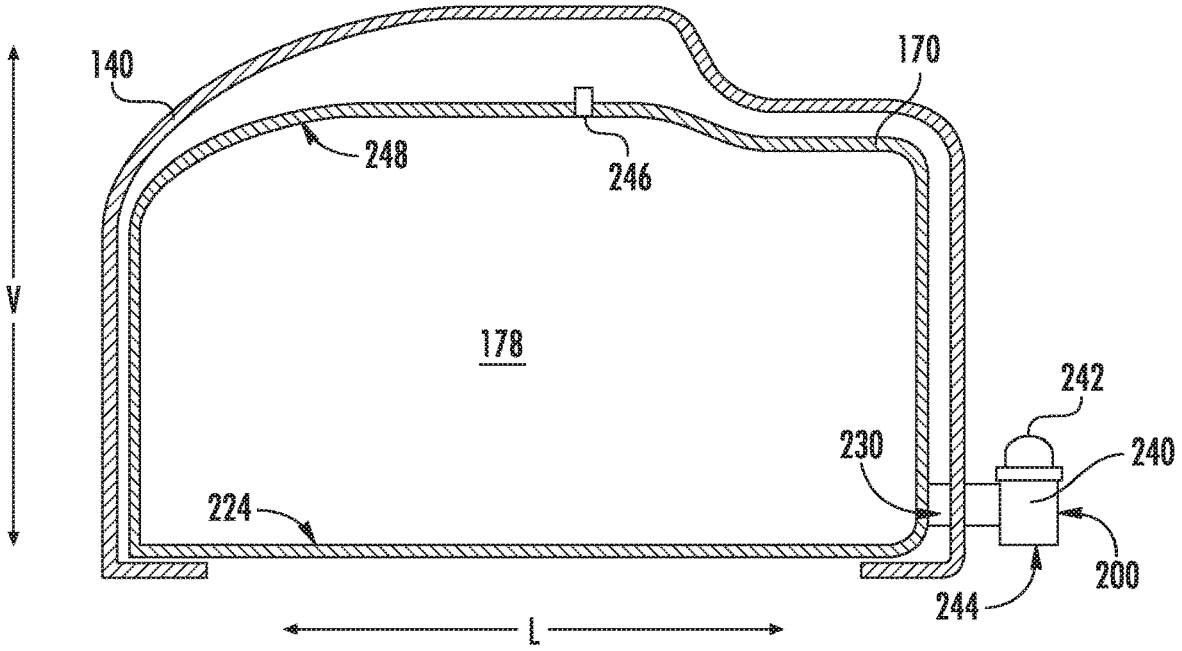
FIG. 8 provides a front cross sectional view of the exemplary dispensing assembly of FIG. 7 according to an exemplary embodiment of the present subject matter.

Referring now to FIGS. 7 and 8, dispensing device 200 will be described according to another embodiment. As illustrated, dispensing device 200 includes a manual valve 240 for selectively dispensing liquid detergent from reservoir 178. For example, manual valve 240 may be actuated by a push button 242 or standard manual valve lever or knob to permit the flow of liquid detergent from reservoir 178. As illustrated, manual valve 240 extends substantially along the horizontal direction (e.g., as defined by the lateral direction L and the transverse direction T). Specifically, manual valve 240 extends over and into opening 105 in top panel 140 such that a dispensing outlet 244 is positioned over wash tub 120. In addition, manual valve 240 extends from the lowest point reservoir 178, e.g. horizontally from bottom 224 of first bulk tank 170. In addition, to prevent a negative pressure within reservoir 178 from preventing the flow of liquid detergent, first bulk tank 170 defines a vent 246 on a top wall 248 of reservoir 178.

Dispensing devices 200 as described above provide a quick and easy means for pretreating an article of clothing with a pretreatment or wash additive, such as liquid detergent or another additive, prior to a wash cycle. In addition, dispensing devices 200 may be integral with washing machine appliance 100, such that mess associated with separate applicators is eliminated and a neat, consumer-desirable solution is obtained. Dispenser devices 200 are also easily accessible at top panel 140, e.g., when door 130 is in the open position, as it would be prior to a wash cycle. It should be appreciated that the dispenser devices 200 described herein are only exemplary and are not intended to limit the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical, a lateral, and a transverse direction, the washing machine appliance comprising:

a cabinet including a top panel;

a wash tub positioned within the cabinet and defining a wash chamber for receipt of articles for washing;

a bulk tank positioned below the top panel and defining a reservoir for storing wash additive, the reservoir defining a primary outlet in fluid communication with the wash chamber; and a dispensing device comprising a dispensing inlet that is separate from the primary outlet and is fluidly coupled to the reservoir, the dispensing device being configured for selectively dispensing the wash additive, wherein the dispensing device comprises a control valve and relies on gravity to dispense the wash additive.

2. The washing machine appliance of claim 1, wherein the dispensing device is positioned on a front of the cabinet.

3. The washing machine appliance of claim 2, wherein the front of the cabinet defines a dispenser recess, the dispensing device being positioned within the dispenser recess.

4. The washing machine appliance of claim 3, wherein the dispenser recess defines a cup holder for receiving a container for receiving the wash additive from the dispensing device.

5. The washing machine appliance of claim 1, wherein the dispensing device is positioned on the top panel above the bulk tank, the dispensing device extending substantially along the vertical direction.

6. The washing machine appliance of claim 1, wherein the dispensing device extends substantially along a horizontal direction into an opening in the top panel such that a dispensing outlet is positioned over the wash tub.

7. The washing machine appliance of claim 1, wherein the dispensing inlet of the dispensing device is positioned at a lowest point of the reservoir along the vertical direction.

8. The washing machine appliance of claim 1, wherein the bulk tank defines a vent at a highest point of the reservoir.

9. The washing machine appliance of claim 1, a door rotatably mounted to the wash tub for providing selective access to the wash chamber, wherein the dispensing device is positioned below the door when the door is in a closed position.

10. The washing machine appliance of claim 1, wherein the dispensing device comprises a manual pump dispenser comprising a dip tube that extends to a bottom of the reservoir.

11. The washing machine appliance of claim 1, wherein the dispensing device comprises an electronic pump attached to the bulk tank in fluid communication with the reservoir to direct the wash additive therefrom.

12. The washing machine appliance of claim 1, wherein the dispensing device further includes a water feed line for supplying a flow of water through the dispensing device.

13. The washing machine appliance of claim 1, wherein the bulk tank and the top panel define a loading port for receiving the wash additive within the reservoir.

14. The washing machine appliance of claim 13, wherein the loading port is defined adjacent the dispensing device on the top panel.

15. The washing machine appliance of claim 1, wherein the dispensing device is a first dispensing device and the wash additive is a first wash additive, the washing machine appliance further comprising:

a second bulk tank defining a second reservoir for storing a second wash additive; and a second dispensing device fluidly coupled to the second reservoir, the second dispensing device being configured for selectively dispensing the second wash additive.

16. A bulk dispensing assembly for a washing machine appliance, the washing machine appliance comprising a cabinet including a top panel and a wash tub positioned within the cabinet and defining a wash chamber, the bulk dispensing assembly comprising:

a bulk tank positioned below the top panel and defining a reservoir for storing wash additive, the reservoir defining a primary outlet in fluid communication with the wash chamber; and a dispensing device fluidly coupled to the reservoir, the dispensing device comprising a manual pump dispenser having a dip tube that extends to a bottom of the reservoir and is configured for selectively dispensing the wash additive.

17. The bulk dispensing assembly of claim 16, wherein a front of the cabinet defines a dispenser recess, the dispensing device being positioned within the dispenser recess.

18. The bulk dispensing assembly of claim 16, wherein the dispensing device extends substantially along a horizontal direction such that a dispensing outlet is positioned over the wash tub.

19. A bulk dispensing assembly for a washing machine appliance, the washing machine appliance comprising a cabinet including a top panel and a wash tub positioned within the cabinet and defining a wash chamber, the bulk dispensing assembly comprising:

a bulk tank positioned below the top panel and defining a reservoir for storing wash additive, the reservoir defining a primary outlet in fluid communication with the wash chamber; and a dispensing device positioned on the top panel above the bulk tank and being fluidly coupled to the reservoir, the dispensing device being configured for selectively dispensing the wash additive.

* * * * *